US006764161B1

(12) United States Patent
Nakagawa et al.

(10) Patent No.: US 6,764,161 B1
(45) Date of Patent: Jul. 20, 2004

(54) CURVED WIPER BLADE SYSTEM FOR INKJET PRINTHEADS

(75) Inventors: Takaaki Nakagawa, Camas, WA (US); Jeffrey K. Pew, Osweg, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/625,856

(22) Filed: Jul. 22, 2003

Related U.S. Application Data

(63) Continuation of application No. 10/015,818, filed on Oct. 30, 2001, now Pat. No. 6,655,781.

(51) Int. Cl.[7] ..... B41J 23/00
(52) U.S. Cl. ..... 347/33
(58) Field of Search ..... 347/22, 33

(56) References Cited

U.S. PATENT DOCUMENTS 5,555,461 A * 9/1996 Ackerman ..... 347/33
6,193,357 B1 * 2/2001 Medin ..... 347/33

* cited by examiner

*Primary Examiner*—Thinh Nguyen

(57) ABSTRACT

A curved wiper blade system is provided for an inkjet printing mechanism to remove ink residue from an inkjet printhead installed in the printing mechanism, here, ill as an inkjet printer. A pair of wiper blades each curve inwardly toward each other, and maintain this curvature during bi-directional wiping strokes. This configuration allows one wiper blade to receive an ink solvent from an applicator and apply the solvent to the ink-ejecting nozzles of the printhead when moving in one wiping direction. When wiping in the opposite direction, one wiper blade also removes ink residue from an interconnect portion of the printhead, as well as from the ink-ejecting orifice plate portion of the printhead.

20 Claims, 5 Drawing Sheets

CURVED WIPER BLADE SYSTEM FOR INKJET PRINTHEADS

This is a continuation of application Ser. No. 10/015,818 filed on Oct. 30, 2001, now U.S. Pat. No. 6,655,781, which is hereby incorporated by reference herein.

INTRODUCTION

The present invention relates generally to inkjet printing mechanisms, and more particularly to a curved wiper blade system for removing ink residue from an inkjet printhead in an inkjet printing mechanism.

Inkjet printing mechanisms use pens which shoot drops of liquid colorant, referred to generally herein as "ink," onto a page. Each pen has a printhead formed with very small nozzles through which the ink drops are fired. To paint an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resins, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contacts and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead sure to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper.

One way to improve nozzle wiping efficiency is through the use of fluid assisted wiping, where the service station stores a supply of a non-volatile ink solvent fluid, such as glycerol or polyethylene glycol ("PEG"), with the wiper occasionally picking up some of the cleaning fluid and transferring it to the printhead nozzle plate. One inlet printer having such a solvent application system is the Hewlett-Packard Company's model 2000C Professional Series Inkjet Printer. This wiper fluid also acts as a lubricant to minimize nozzle bore deformation that may occur due to the wiping action. Unfortunately, while the earlier wiper designs allowed for an easy pick and dispense of the fluid onto the nozzle plate, they were not well suited for removing the resulting waste ink and fluid mixture from the nozzle plate.

For ire, FIG. 8 shows a side elevational view of such an earlier wiper system during a wiping stroke, with FIG. 9 being side elevational of a later stage of the wiping stroke, while FIG. 10 shows an enlarged view of an intermediate stage of the wiping stroke. In FIG. 8, we see an inkjet cartridge C having a printhead P which is being wiped by a dual bladed wiper system W, which has a first wiper blade B1 and a second wiper blade B2. The wiper system W is constructed as described in U.S. Pat. No. 5,614,930, currently assign to the present assignee, the Hewlett-Packard Company. Each of the wiper blades B1 and B2 have wiper tips with an arcuate exterior wiping edge and an angular interior wiping edge as described in U.S. Pat. No. 5,614,930.

When wiping in a direction D, the rounded exterior wiping edge of the first wiper blade B1 is used to wick or draw ink from the nozzles through capillary action. This wicked ink is then moved by blade B1 along succeeding nozzles to dissolve ink residue accumulated on the nozzle plate. The angular interior wiping edge of the second wiper blade B2 then scrapes away the extracted ink and dissolved ink residue, along with any other debris from the nozzle plate P. Unfortunately in some cases, after much use, the second wiper blade B2 was not able to efficiently remove the ink residue from the nozzle plate, and instead, merely spread the dirty fluid mixture over the nozzle plate. In extreme cases, the accumulated dirty fluid/ink mixture could migrate to the sides of the nozzle plate, or to the back of the nozzle area where the printhead receives electrical signals from an electrical interconnect I, corroding the electrical traces on the interconnect or causing electrical shorts between the interconnect traces.

FIG. 10 illustrates another problem associated with the earlier wiper blade designs. The action of FIG. 10 occurs between that shown in FIGS. 8 and 9. In FIG. 8 we see the second wiper blade B2 has just come into contact with the interconnect I. In this flat-to-flat contact position, wiper blade B2 has no ability to wipe ink, ink residue, or any combination thereof from the interconnect I. Quite to the contrary, as shown in FIG. 10, any ink solvent and/or ink residue remaining on the interior surface of the wiper blade B2 is actually clean from the wiper blade by the corner between the orifice plate P and the interconnect I, leaving an undesirable deposit of solvent and residue are along interconnect I. Eventually, a leading amount of fluid may accumulate along the lower portion of the interconnect I, leading to additional electrical trace corrosion and/or electrical ink shorts caused by ink bridging between the electrical traces.

DRAWING FIGURES

DETAILED DESCRIPTION

Figure 1:
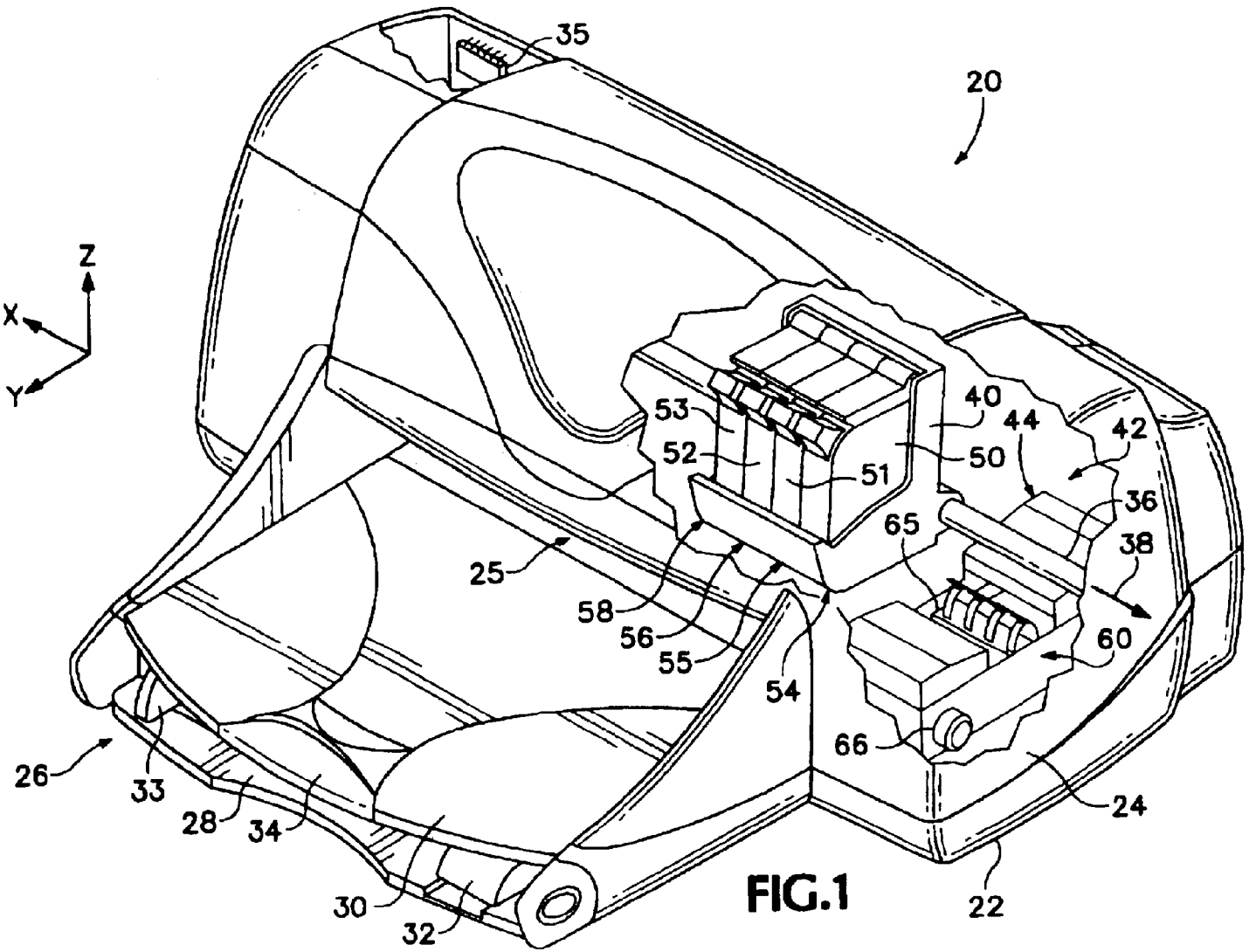
FIG. 1 is a perspective view of one form of an inkjet printing mechanism, here shown as an inkjet printer, having a service station with one form of a curved wiper blade system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an in printer 20.

While it is apparent that the printer components may vary from model to model, the typical inkjet printer 20 includes a chassis 22 surrounded by a housing or casing enclosure 24, typically of a plastic material. Sheets of print media are fed though a printzone 25 by a print media handling system 26. The print media may be any type of suitable sheet material, such as paper, card-stock, transparencies, mylar, and the like, but for convenience, the illustrated embodiment is described using paper as the print medium. The print media handling 26 has a feed tray 28 for storing sheets of paper before printing. A series of conventional motor-driven paper drive rollers (not shown) may be used to move the print media from tray 28 into the printzone 25 for printing. After printing, the shin then land on output tray portion 30. The media handling system 26 may include a series of adjustment mechanisms for accommodating different sizes of print media, including letter, legal, A-4, envelopes, etc., such as a sliding length and width adjustment levers 32 and 33 for the input tray, and a sliding length adjustment lever 34 for the output tray.

The printer also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. The printer controller 35 may also operate in response to user input provided through a key pad (not shown) located on the exterior of the casing 24. A monitor coupled to the computer host may be used to display visual information to an operator, such as the printer status or a particular program being run on the host computer. Personal computers, their input devices, such as a keyboad and/or a mouse device, and monitors are all well known to those skilled in the art.

A carriage guide rod 36 is mounted to the chassis 22 to define a scanning axis 38. The guide rod 36 slideably supports a reciprocating inkjet carriage 40, which travels back and forth across the printzone 25 and into a servicing region 42. Housed within the servicing region 42 is a service station 44, which will be discussed in greater detail below with respect to the present invention. The illustrated carriage 40 carries four inkjet cartridges or pens 50, 51, 52, and 53 over the printzone 25 for printing, and into the servicing region 42 for printhead servicing. Each of the pens 50, 51, 52, and 53 have an inkjet printhead 54, 55, 56, and 58, respectively, which selectively eject droplets of ink in response to firing signals received from the controller 35.

One suitable type of carriage support System is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the of carriage travel.

In the printzone 25, the media sheet receives ink from the inkjet carriages 50, 51, 52 and 53, such as the yellow ink cartridge 50, the ink magenta cartridge 51, the yellow ink cartridge 52, and/or the cyan ink cartridge 53. The cartridges 50–53 are also often called "pens" by those in the art. While the color pens 50, 51 and 53 may contain pigment based inks, for the purposes of illustration, the color pens arc described as containing debased inks. The black ink pen 52 is illustrated herein as containing a pigment-based ink. It is apparent that other types of inks may also be used in pens 50–53, such as thermoplastic, wax or paraffin based inks, as well as hybrid or composite inks having both dye and pigment characteristics. The illustrated pens 5053 each include reservoirs for storing a supply of ink.

The printheads 54–58 each have an orifice plate with a plurality of nozzles formed therethrough in a manner known to those skilled in the art. The illustrated printheads 54–58 are thermal inkjet heads, although other types of printheads may be used, such as piezoelectric printheads. Indeed, the printheads 54–58 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 35 to the printhead carriage 40, and through conventional interconnects between the carriage and pens 50–53 to the printheads 54–58.

Figure 2:
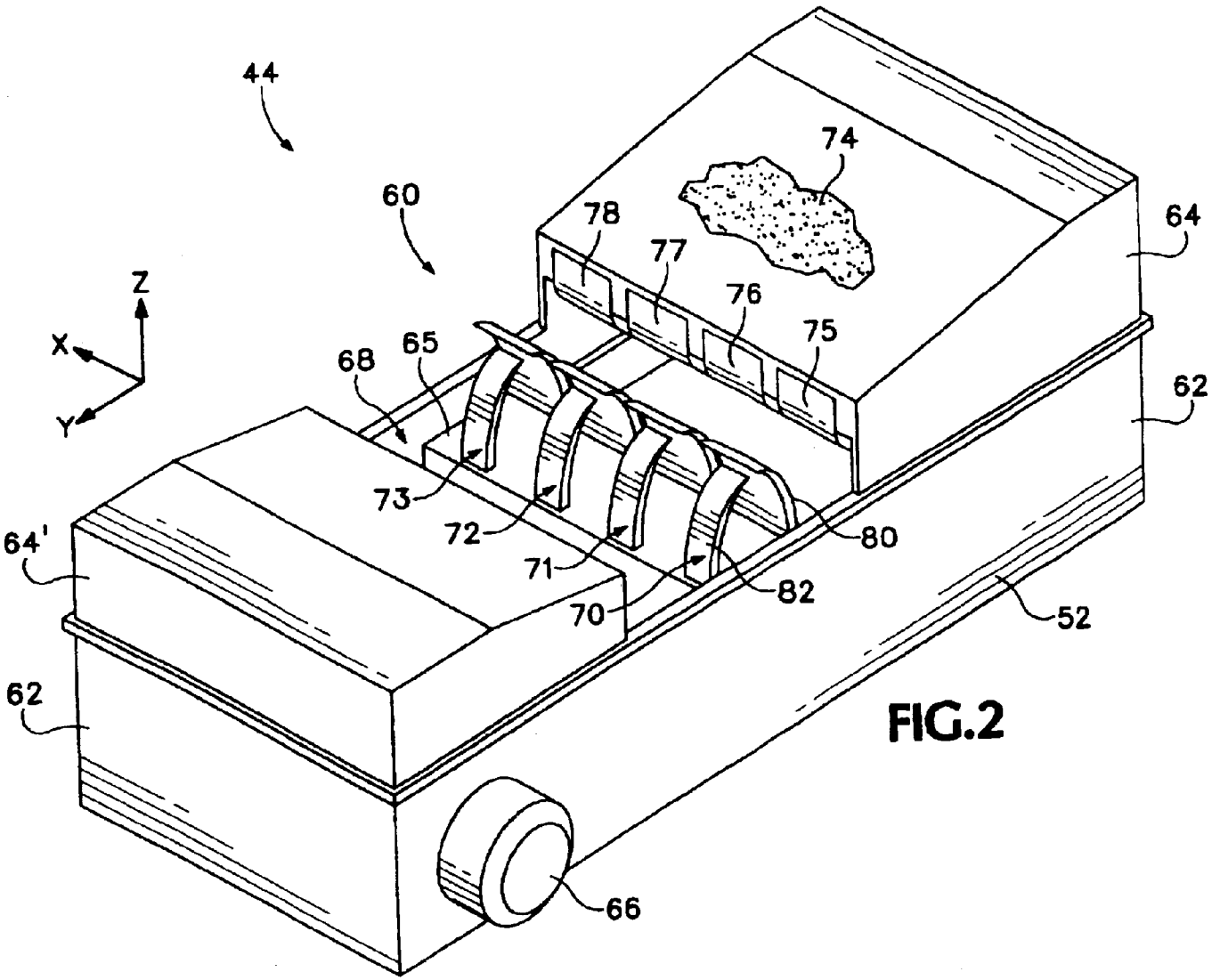
FIG. 2 is an enlarged perspective view of the service station of FIG. 1.

FIG. 2 shows service station 44 as having one form of a curved wiper blade system 60, constructed in accordance with the preset invention The illustrated service station 44 has a base portion 62 and a bonnet portion 64, with a moveable pallet 65 sandwiched therebetween. The pallet is driven forwards and backwards parallel to the Y-axis by a motor 66 and a gear assembly, for instance such as a rack and pinion gear assembly discussed further below with respect to FIG. 3 which may be constructed as described in U.S. Pat. Nos. 5,980,018 and 6,132,026, currently assigned to the present assignee, the Hewlett-Packard Company. The pallet 65 may carry other printhead servicing components, such as primers or caps, for instance, such as cap 67 shown schematically in dashed lines in FIG. 3. The caps are moved into position under their associated printheads and elevated to cap each of the printheads 54–58. The interior of the service station base 62 forms a spittoon 68, which is exposed to receive ink purged or spit from the printheads 54–58 when the pallet 65 is moved partially or totally under bonnet 64.

The curved blade wiper system 60 has four sets of wiper blades 70, 71, 72 and 73, which each wipe printheads 54, 55, 56 and 58, respectively. To assist in the wiping, one portion of the bonnet 64 houses an ink solvent reservoir 74, which may be filled with any type of suitable ink solvent, but in the illustrated embodiment it is preferably filled with a polyethyl glycol ("PEG") solvent. The service station 44 has four solvent applicators 75, 76, 77, and 78 which are in fluid communication with the solvent reservoir 74, to extract solvent therefrom and have it available along their outer surfaces for application to the wiper blades.

Figure 3:
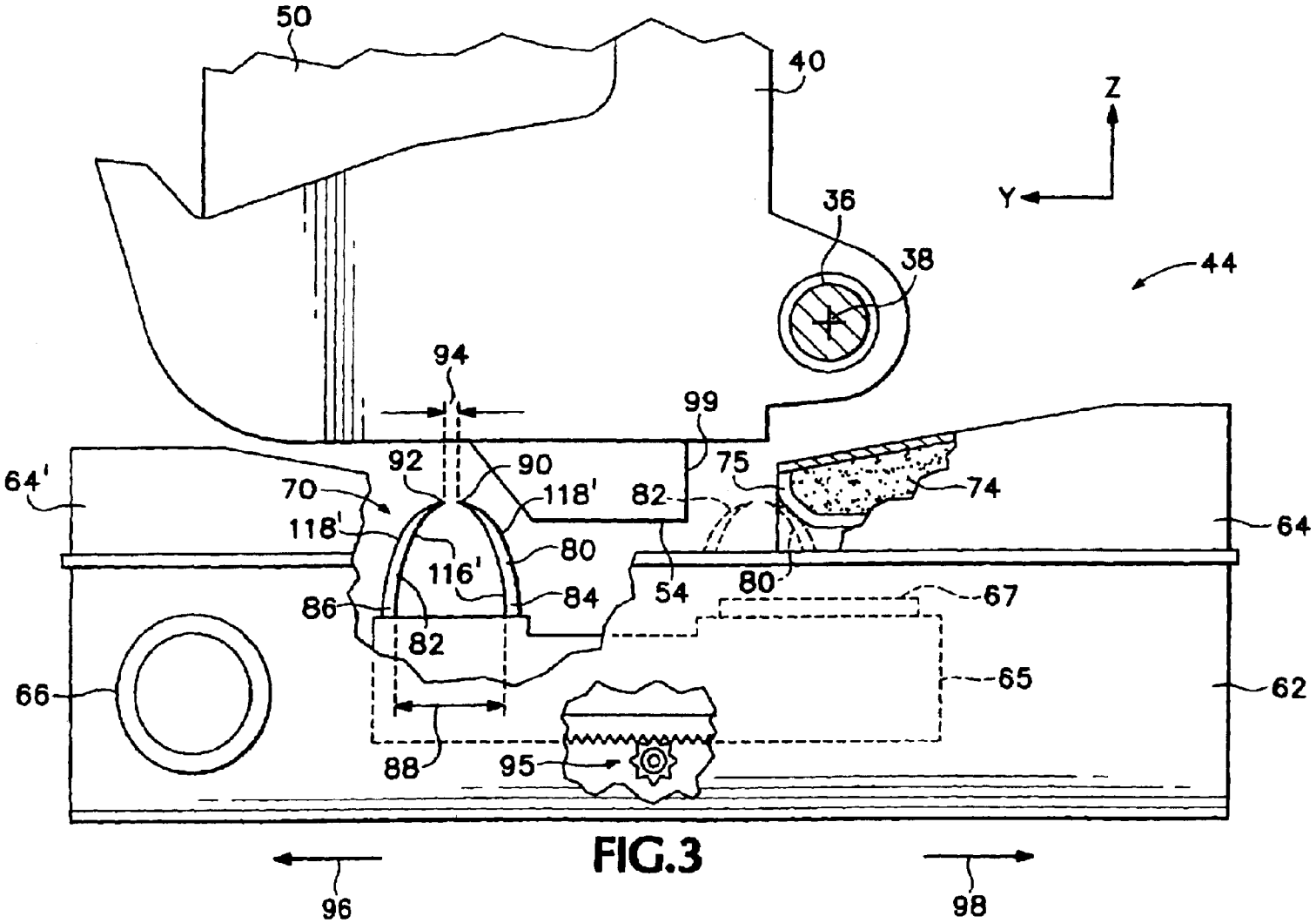
FIG. 3 is an enlarge side elevational view of one inkjet cartridge and the service station of FIG. 1, shown prior to the beginning of a wiping stoke.

Each of the wiper blade sets 70, 71, 72, and 73 has a first blade 80 and a second wiper blade 82. The wide wiper/narrow wiper combination was first introduced in the Hewlett-Packard Company's model 2000C Professional Series Color Inkjet Printer using upright wiper blades having a tip configuration, such as those disclosed in U.S. Pat. No. 5,614,930, assigned to the Hewlett-Packard Company. In the illustrate embodiment, the first wiper blade 80 is wider in width than the second wiper blade 82, allowing the wide wiper blade 80 to clean the entire orifice plate surface, while the narrow wiper blade 82 concentrates along the linear any of nozzles, which we centrally located in the orifice plate. FIG. 3 shows the yellow wide wiper blade 80 in dashed lines contain the solvent applicator 75 in operation, which preferably occurs when the carriage 40 has the pens 50–53 removed from the servicing area 42 and over the printzone 25. FIG. 3 shows the yellow wiper blade set 70 in solid line after it has received the solvent from applicator 75, aid in an initial position before the beginning of a wiping routine, as representative of each of the wiper blade sets 70–73.

FIG. 3 shows the yellow wiper blade set 70, poised ready for wiping the yellow printhead 54. The wide wiper blade 80 has a base 84, while the narrow blade 82 has a base 86. Please note that while these principles are illustrated using a wide/narrow wiper blade set, these principles apply equally if both blades are of the same width, which may be preferable in some implementations. The blade bases 84 and 86 are separated by a base spacing, indicated as dimension 88 in FIG. 3. Distal firm the base, the wide blade 80 has a tip 90 and the narrow blade 82 has a tip 92, with the tips 90 and 92 being separated by a tip spacing, indicated as dimension 94 in FIG. 3. The inwardly curved nature of each of the wiper blades 80, 82 yields a base spacing dimension 88 which is wider than the tip spacing 94, yielding a unique configuration when compared to the earlier upright parallel wiper blades, such as those disclosed in U.S. Pat. No. 5,614,930, mentioned above, and which was first commercially available in the Hewlett-Packard Company's Model 850C and 855C Color Inkjet Printer.

As mentioned above, FIG. 3 shows that a conventional gear assembly may be used to couple the motor 66 to a rack and pinion gear assembly 95, with the pallet 65 carrying the rack portion of assembly 95. Together, the motor 66 and the gear assembly 95 cooperate to drive the pet 65 in a forward direction 96 and a rearward direction 98. A front portion 64' of the service station bonnet may include a wiper scraper blade, which removes ink residue from the wiper blades 80, 82 as they enter and exit from a storage position underneath the front bonnet portion 64', for instance as described in U.S. Pat. Nos. 5,980,018 and 6,132,026, mentioned above.

Figure 4:
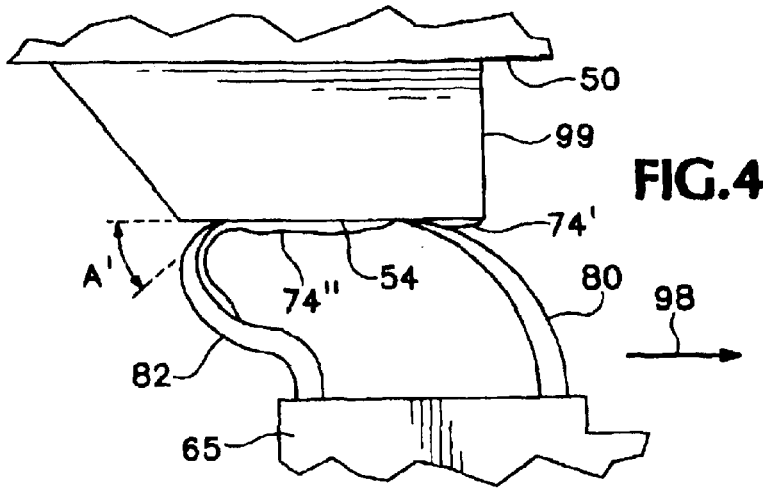
FIG. 4 is an en side elevational view of a first stage of a wiping stroke using the service station of FIG. 1.

From the ink solvent pick position shown in dashed lines in FIG. 3, motor 66 drives the pallet 65 in the forward direction 96 until reaching the initial wiping position shown solid lines in FIG. 3. From the position in FIG. 3, the motor drives the wipers in the rot direction 98, as shown in FIG. 4 to allow the wide wiper blade 80 to apply ink solvent 74' to the surface of printhead 54. A mixture of ink residue and solvent 74' is then formed on the orifice plate after the passage of the wide wiper blade 80. This mixture of ink solvent and ink residue 74" is then removed immediately by blade 82 from the portion of the orifice plate where the linear nozzle arrays reside, as shown in FIG. 4. After passing over the entire printhead 54, the pallet 65 reverses direction and begins moving in the forward direction 96, as shown in FIG. 5.

Figure 5:
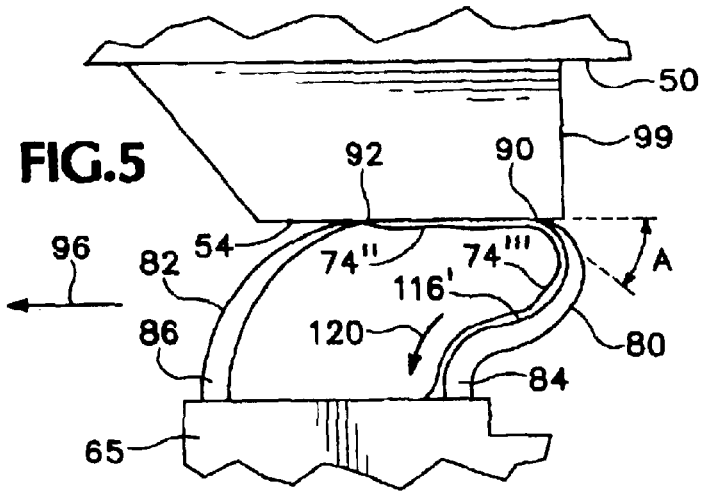
FIG. 5 is an enlarged side elevational view of a second stage of a wiping stroke using the service station of FIG. 1.

In FIG. 5 we see the narrow wiper 82 is configured to wick ink from the nozzles and drag it along the linear nozzle array, in the same manner as described in U.S. Pat. No. 5,614,930 previously mentioned. However, in the second portion of the wiping stroke, the wide wiper blade 80 vigorously attack ink solvent and residue or other debris 74" along the orifice plate in a scraping or bulldozing action, removing the mixture 74" from both the outer regions of the orifice plate and along the linear nozzle arrays. This scraping angle of attack A, shown in FIG. 5, of the trailing blade, and shown as A' in FIG. 4 for the narrow blade 82, is an acute angle, as opposed to an obtuse angle T shown in FIG. 9 between the leading surface of the trailing blade B2 and the surface of printhead P which bas just been wiped. The acute angle of attack A, A' of the trailing blade is believed to better clean and remove ink residue from the printhead orifice plate than the earlier use of an obtuse angle of attack T.

Figure 6:
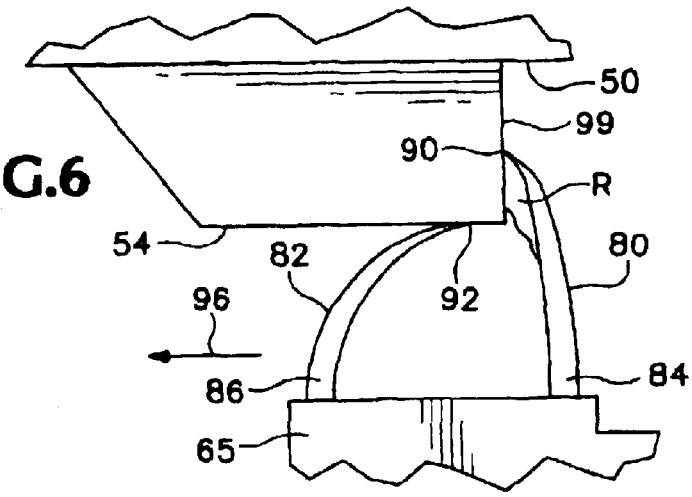
FIG. 6 is an enlarged side elevational view of an intermediate stage of a wiping stroke using the service station of FIG. 1.

FIG. 6 illustrates an interconnect wiping stage, which occurs between the wiping stages shown in FIGS. 4 and 5. In FIG. 6, we see an interconnect portion 99 of the yellow cartridge 50 being wiped by wiping tip 90 of the wide wiper blade 80. The interconnect portion 99 carries signals between the controller 35 and the printhead 54, such as the firing signals to resistors which cause ink to be ejected from the nozzles, and temperature sensing signals which sense the printhead temperature and provide feedback to controller 35. Other signals may also be communicated by the interconnect portion 99, such as various printhead identification signals to let controller 35 know whether and when a new pen 50–53 has been inserted in carriage 40. The electrical interface pads between the pens 50–53 and the carriage 40 are located above the interconnect trace portion 99 shown in FIG. 6. Maintaining pen cleanliness in the interconnect portion 99 is important for many reasons, including those discussed in the Introduction section above. In FIG. 6, we see the inwardly curving tip 90 of the wide wiper blade 80 vigorously attacking and removing ink residue from the interconnect 99. In comparing the angle of attack of blade tip 90 with that of blade B2 shown in FIG. 10, we see wiper tip 90 actively removing ink residue R from the interconnect I, as opposed to the prior art blade B2 which actually deposit residue along the interconnect I of FIG. 10.

Figure 7:
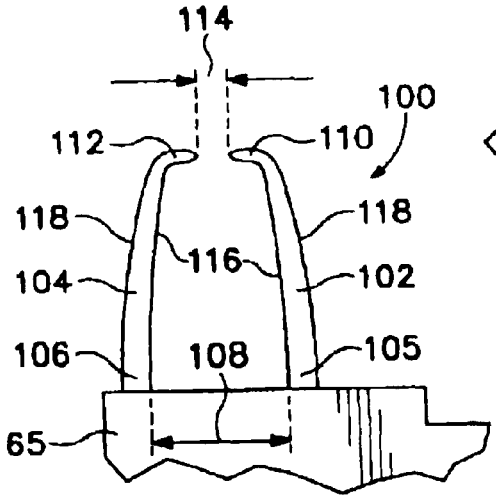
FIG. 7 is an enlarged side elevational view of an alternate embodiment of a curved wiper blade system which may be used in the service station of FIG. 1.

FIG. 7 illustrates an alternative embodiment of another curved blade wiper system 100, constructed in accordance with the present invention, which may be substituted for one or all of the blade systems 70–73 shown in FIGS. 1–6. First and second wiper blades 102, 104 have bases 105, 106, respectively, extending upwardly from the pallet 65. The blade bases 105 and 106 are separated by a base spacing labeled as dimension 108 in FIG. 7. The distal end of the wiper blades 102, 104 each terminate in an inwardly hooked wiping tip 110, 112, respectively. The inwardly hooked wiper tips 110 and 112 are separated by a spacing distance labeled as dimension 114 in FIG. 7, with the tip spacing distance 114 being less that the base spacing distance 108. The inwardly hooked wiping tips 110, 112 function as described above with rod to FIGS. 4–6 for the wiper blade sets 70–73, including cleaning of the interconnect portion 99 as shown in FIG. 6. The inwardly hooked wiping tips 110, 112 when in a trailing position also attack the printhead at an acute angle, similar to angles A' and A shown in FIGS. 4 and 5, rather than the obtuse angle T of FIG. 9.

Figure 8:
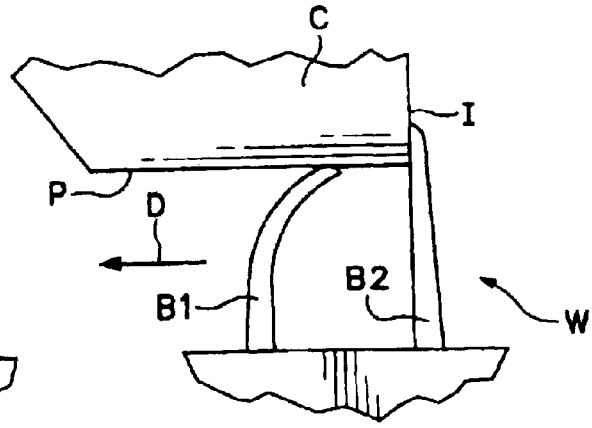
FIG.8 PRIOR ART
FIG. 8 is an enlarged side elevational view of a prior art dual blade wiping system shown during an initial phase of a wiping stoke.
Figure 9:
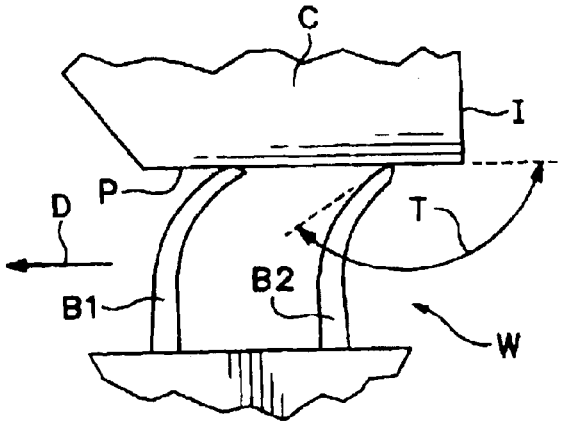
FIG.9 PRIOR ART
FIG. 9 is an enlarged side elevational view of the prior art wiping system of FIG. 8, shown during a later stage of the wiping stroke.
Figure 10:
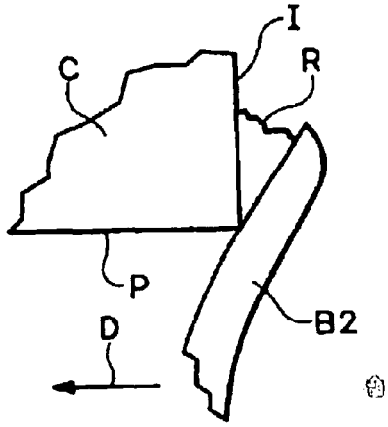
FIG.10 PRIOR ART
FIG. 10 is an enlarged, side elevational, detailed view of the prior at wiping system of FIG. 8, shown during an intermediate portion of the wiping stroke.

The wiper blade sets 70–73 and 100 may also be distinguished by their cross-sectional profiles, where each blade 102, 104 has a concave interior surface 116, and a convex exterior surface 118, whereas for blade set 70–73, they each share an interior concave surface 116' and an exterior convex surface 118' (FIG. 3). These concave interior surfaces 116, 116' and convex exterior surfaces 118, 118' are quite different from the planar parallel surfaces of the prior art blades B1, B2 of FIGS. 8–10. Indeed, another way of distinguishing the curved wiper blades 70–73 and 100 from the prior art wiper sets W of FIGS. 8–10 is by the trailing blade having an obtuse angle of attack, which is 180° minus angle A or A', versus the prior art bailing blade B2 having an acute angle of attack, which is equal to 180° minus the angle T of FIG. 9.

The ability of wipers 70–73, 100 to effectively remove fluid and ink residue from the interconnect portion 99 of the pens 50–53 reduces the occurrence of fluid-induced printhead failures, such as electrical shorts and electrical trace corrosion in the interconnected region 99 which were discussed above in the introduction section. Furthermore, the curved wiper blade system 60, 100 may be implemented using current solvent application techniques, such as shown in FIGS. 2 and 3. Moreover, the exact shape and configuration of wipers 70–73 and 100 may be varied to better control the wiping force through curvature changes, dimensional changes and/or material changes, such as durometer changes, to balance between excessive wiping force which causes nozzle bore deformation, and insufficient wiping force which leads to inefficient cleaning of the nozzle plate, resulting in nozzle plugs and misdirected ink drops from partially plugged nozzles. The curved wiping tips prevent the wipers from hydroplaning over waste fluid on the nozzle plate, and allow removed residue 74" (FIG. 5) to flow downwardly along the trailing blade interior 116, as indicated by arrow 120 in FIG. 5, and eventually fall into soon 68. Either wiper design 70–73, 100 may be molded with pass core techniques or through using extrusion techniques. Finally, the illustrated embodiments described above with respect to FIGS. 1–7 illustrate the principles and concepts of the invention as set forth in the claims below, and a variety of modifications and variations may be employed in various implementations, while still falling within the scope of the claims below.

We claim:

1. A method of cleaning ink residue from an inkjet printhead having an ink ejecting orifice plate in a first plane and an interconnection feature in a second plane which is non-planar with said first plane, with the orifice plate and the interconnection feature being joined together along an edge, comprising:

wiping the interconnection feature along said interconnection feature to said edge;

wiping said edge; and wiping said orifice plate from said edge.

2. A method according to claim 1 wherein said printhead is held stationary during said wiping steps.

3. A method according to claim 1 wherein said step of wiping the interconnection feature comprises scooping ink residue off of the interconnection feature.

4. A method according to claim 1 wherein said step of wiping said edge comprises scooping ink residue off of the edge.

5. A method according to claim 1 wherein said step of wiping said orifice plate comprises scooping ink residue off of the orifice plate.

6. A method according to claim 1 further comprising, prior to said wiping steps:

wicking ink from nozzles of the office plate; and dissolving ink residue on the orifice plate with the wicked ink.

7. A method according to claim 6 wherein:

said step of wicking ink comprises extracting ink through capillary forces generated by dragging a first wiper blade across the orifice plate; and said wiping steps comprise dragging a second wiper blade across the interconnection feature, the edge and the orifice plate.

8. A method according to claim 1 wherein said first and second planes are substantially perpendicular.

9. A wiper system for cleaning ink residue from a printhead in an inkjet printing mechanism, comprising:

a support; and a wiper blade supported by said support to wipe ink residue from the printhead through relative motion between said printhead and said wiper blade, said blade having a length and a leading surface with a concave contour, said blade tapering along said length to a wiping tip.

10. A wiper system according to claim 9 wherein said blade has a first thickness in a base region and a second thickness in a tip region which is less than said first thickness.

11. A wiper system according to claim 9 wherein said blade has a second surface opposite said leading surface, said opposite surface having a convex contour.

12. A wiper system according to claim 9 wherein:

said support comprises a sled which is movable between a rest position and a wiping stroke; and wherein said relative motion comprises holding the printhead stationary while moving the wiper blade through a wiping stroke.

13. A wiper system according to claim 9 wherein during wiping said wiper blade leading surface has a contour with both concave and convex components.

14. A wiper system according to claim 9 wherein during wiping said wiper blade leading surface retains at least some of its concave contour.

15. A wiper system for cleaning ink residue from a printhead in an inkjet printing mechanism, comprising;

a support; and a wiper blade supported by said support to wipe ink residue from the printhead through relative motion between said printhead and said wiper blade, said blade having a leading surface with a concave contour, a first thickness in a base region and a second thickness in a tip region, wherein said second thickness is less than said first thickness.

16. A wiper system according to claim 15 wherein said blade has a length and wherein said blade tapers along said length to a wiping tip.

17. A wiper system according to claim 15 further comprising a second wiper blade supported by said support and having a leading surface with a concave contour, a first thickness in a base region and a second thickness in a tip region, wherein said second thickness of the second blade is less than said first thickness of the second blade.

18. A wiper system according to claim 17 wherein said wiper blade and said second wiper blade curve inwardly toward each other in said tip regions.

19. A wiper system for cleaning ink residue from a printhead in an inkjet printing mechanism, comprising:

a support; and a wiper blade supported by said support to wipe ink residue from the printhead through relative motion between said printhead and said wiper blade, said blade having a leading surface with a smooth concave contour.

20. A wiper system according to claim 19 wherein said blade has a first thickness in a region adjacent said support and a second thickness in a region opposite said support, said first thickness being greater than said second thickness.

* * * * *